United States Patent [19]

Belgarde

[11] Patent Number: 4,854,151

[45] Date of Patent: Aug. 8, 1989

[54] APPARATUS FOR REALIGNING VEHICLE BODY AND FRAME MEMBERS

[76] Inventor: Richard J. Belgarde, 4440 Waimea Ct., San Jose, Calif. 95118

[21] Appl. No.: 121,096

[22] Filed: Nov. 16, 1987

[51] Int. Cl.[4] ..... B21D 1/12

[52] U.S. Cl. ..... 72/447; 72/705

[58] Field of Search ..... 72/705, 447; 248/331

[56] References Cited

U.S. PATENT DOCUMENTS

| | | | |
|---|---|---|---|
| 3,088,513 | 5/1963 | Marquardt | 72/705 |
| 3,495,798 | 2/1970 | Galbarini et al. | 248/331 |
| 3,754,432 | 8/1973 | Hagerty | 72/705 |
| 3,777,541 | 12/1973 | Whitney | 72/705 |
| 3,796,084 | 3/1974 | Jarman | 72/705 |
| 3,835,693 | 9/1974 | Majersky | 72/705 |
| 4,050,287 | 9/1977 | Borup | 72/705 |
| 4,257,255 | 3/1981 | Sanchez | 72/705 |
| 4,313,335 | 2/1982 | Eck | 72/705 |
| 4,643,015 | 2/1987 | Larson et al. | 72/705 |
| 4,660,405 | 4/1987 | Widegren et al. | 72/705 |

*Primary Examiner*—Lowell A. Larson

*Attorney, Agent, or Firm*—Edward B. Gregg; Paul B. Fihe

[57] ABSTRACT

Disclosed herein is an apparatus for realigning vehicle body and frame members including a movable platform on which a vehicle may rest and a movably supported carrier member connected to such platform and carrying force-exerting means for applying force to vehicle elements at various selected angles.

6 Claims, 2 Drawing Sheets

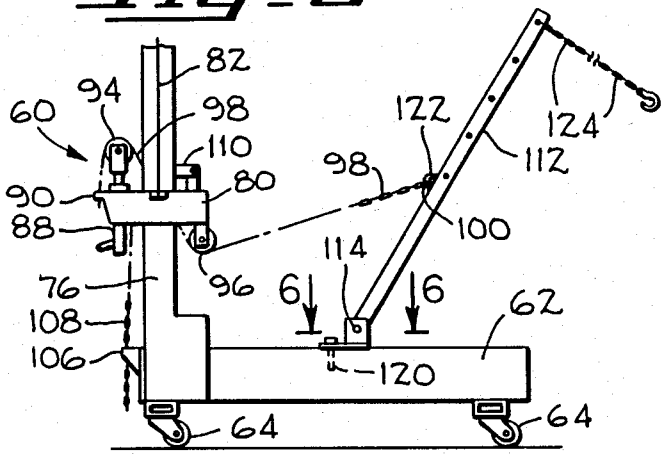
Fig-5
Fig-6
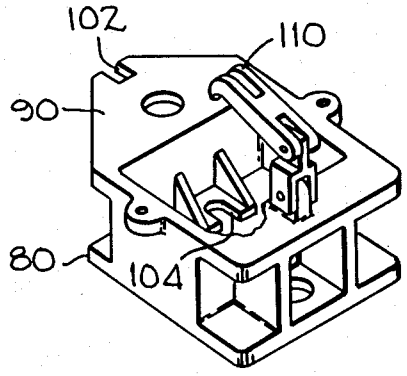
Fig-4
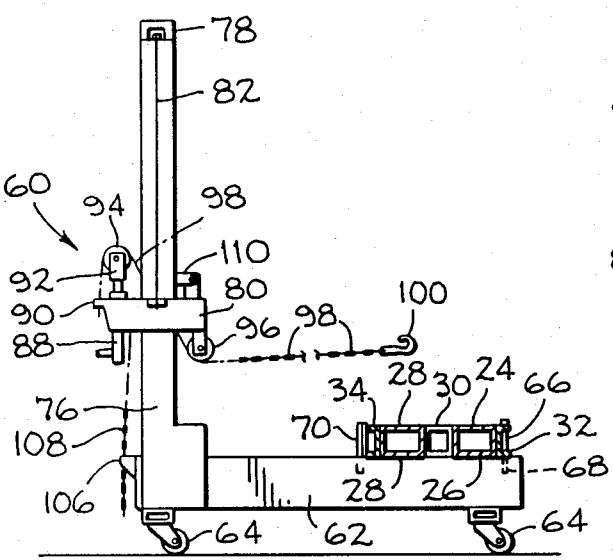
Fig-3
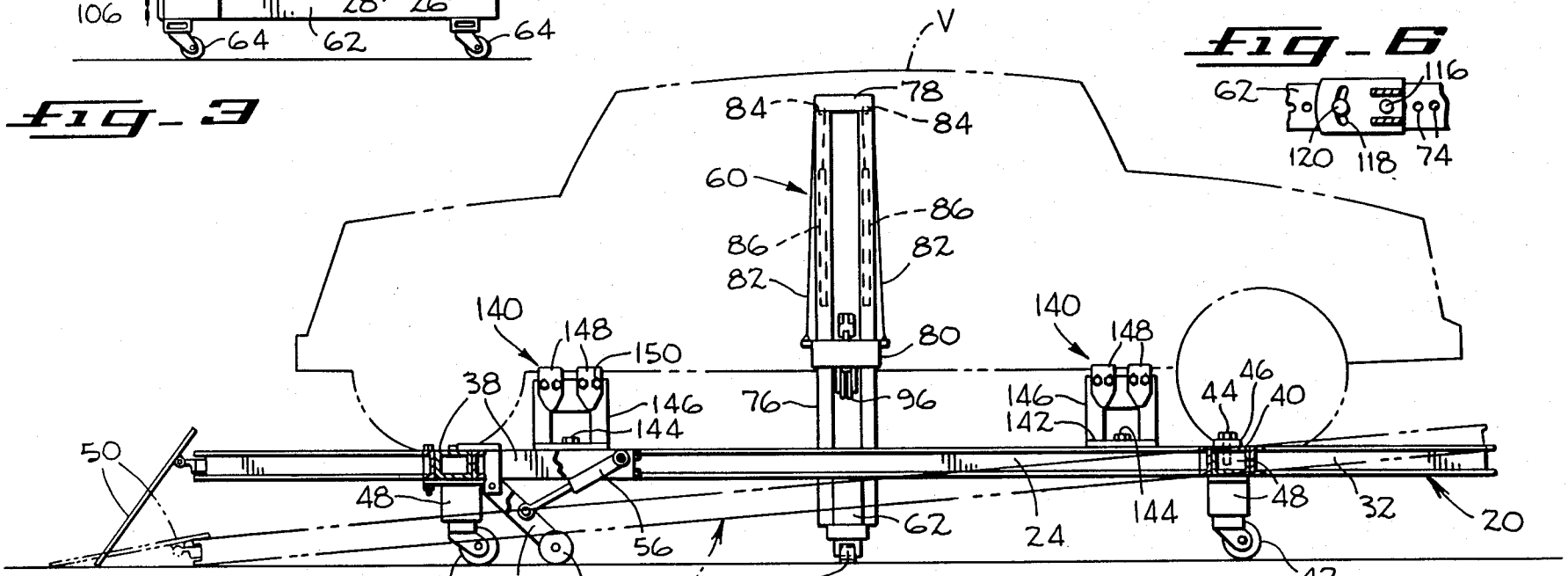
Fig-2

APPARATUS FOR REALIGNING VEHICLE BODY AND FRAME MEMBERS

FIELD OF THE INVENTION

The present invention relates generally to force-exerting mechanisms and, more particularly, to apparatus for exerting force on a bent vehicle frame or body member to effect straightening and realignment thereof.

BACKGROUND OF THE INVENTION

Automobile or other vehicles, which have experienced an accident, frequently have bent and misaligned body or frame members as a result. These must be straightened or realigned to assure proper operation and a number of devices have been developed for this purpose. However, because of the wide variety of misaligned members, the existing equipment is extremely complex and expensive.

Furthermore, a permanent installation is normally required and valuable floor space is occupied even when the equipment is not being used.

SUMMARY OF THE PRESENT INVENTION

Accordingly, it is the general objective of the present invention to provide apparatus for realigning vehicle body and frame members which although relatively simple to make and to use for a wide variety of straightening operations, is also movable to a desired location either for storage or use.

To achieve such objective, the apparatus includes a vehicle-supporting platform upon which the vehicle can rest during the realignment operation. Preferably such platform is composed of two tracks held in appropriately spaced and parallel relation by several transverse beams. Each track is formed by a pair of rectangular elongated metal tubes which are, in turn, held in laterally-spaced relation by a number of stub tubes at intervals. C-shaped angle beams are, in turn, secured to the outer sides of both elongated tubes, the angle beams on the inner sides having a plurality of vertically-disposed openings enabling connection of the force-exerting means at various positions, as will be described hereinafter.

Legs are releasably secured to the tracks adjacent the four corners and carry wheels at their lower ends, enabling the entire platform to be moved over a supporting surface. If two legs at one end of the platform are removed, the platform can drop into alignment with a pivoted ramp enabling driving of a vehicle onto the tracks. A pneumatic ram can be energized to raise the platform (and the vehicle thereon) into a substantially horizontal raised position to facilitate the realignment operation.

The force-exerting means is mounted on a carrier member including a laterally-extending arm movably supported on wheels. At its inner end the arm is pivotally connected at a selected position by insertion of a pivot pin in one of the vertical openings in the tracks. At its outer end, the arm is secured to and supports an upright member that slidably receives a collar with an attached counterweight enabling easy manual raising or lowering of the collar.

Several pulleys are mounted on the collar and a link chain is trained about said pulleys. One end of the chain is fixed to a keeper on the collar and the other free end is adapted for connection to the vehicle at the desired position. To generate a pulling force, a pneumatic ram is secured at its one end to the collar and at its opposite end to one of the pulleys to shift the latter and exert pulling force on the chain. Other keepers on the collar and upright member can releasably hold the collar in its slidably adjusted position.

The laterally-extending arm of the carrier member also can carry a generally upright elongated boom in a fashion allowing pivotal motion about both horizontal and upright axes. The free end of the link chain can be connected to the boom and an additional chain can be connected between the boom and the vehicle facilitating an upward pull on a vehicle body or frame member.

Since sizeable force may be applied to the vehicle, one or more clamps are adjustably secured to the tracks and are adapted for connection to the lower vehicle frame.

BRIEF DESCRIPTION OF THE DRAWINGS

The stated objective of the invention and the manner in which it is achieved, as summarized above, will be more fully understood by reference to the following detailed description of the exemplary embodiment of the invention shown in the accompanying drawings wherein:

FIG. 2 is an elevational view taken along line 2—2 of FIG. 1, FIG. 3 is a vertical sectional view taken along line 3—3 of FIG. 1, FIG. 4 is an enlarged perspective view of an adjustable collar used in exerting forces, FIG. 5 is a view similar to FIG. 3 of a slightly modified arrangement, FIG. 6 is a fragmentary sectional view taken along line 6—6 of FIG. 5.

DETAILED DESCRIPTION OF THE ILLUSTRATED EMBODIMENTS OF THE INVENTION

Figures 1, 7, 8:
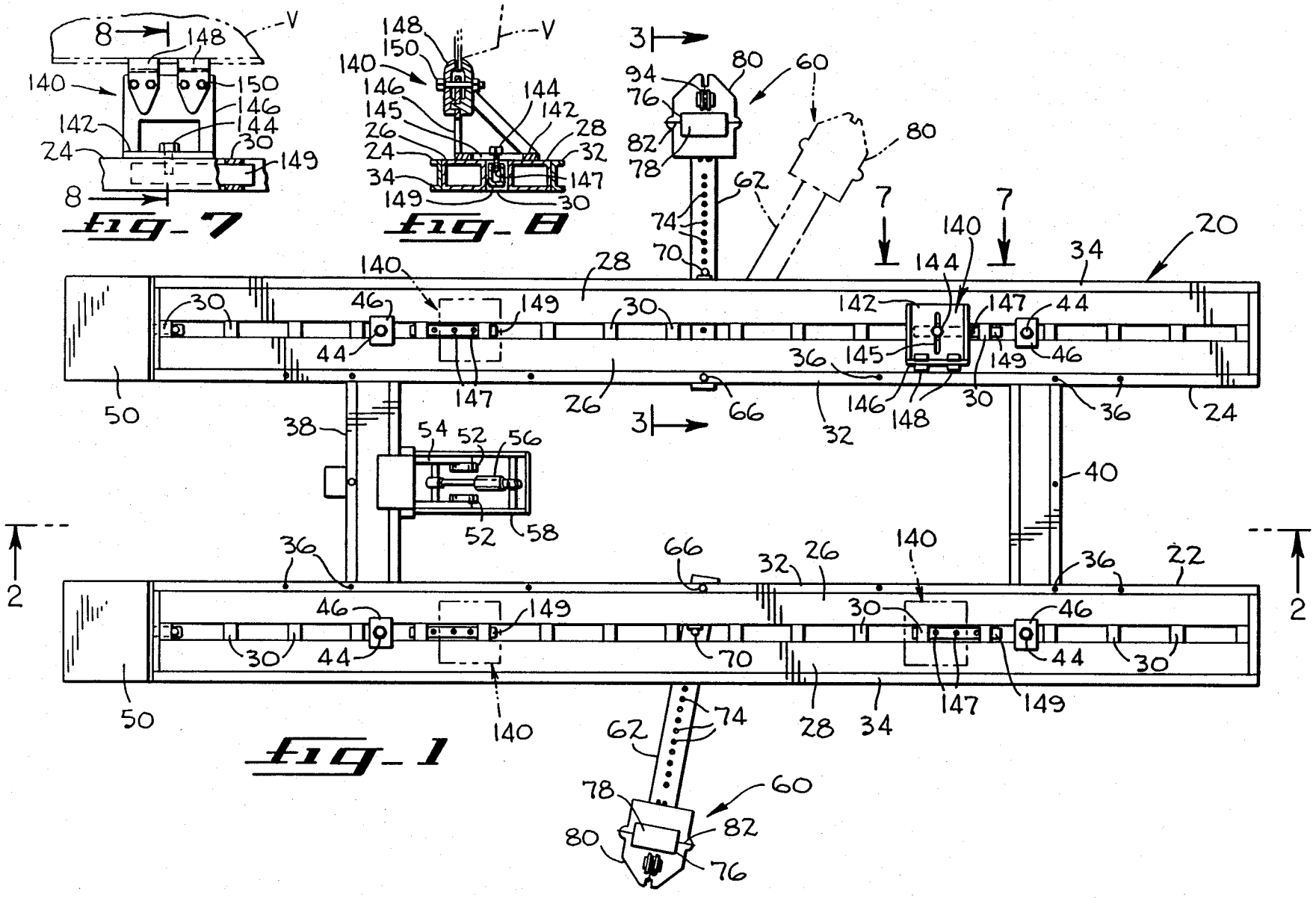
FIG. 1 is a top plan view of a vehicle body and frame realignment apparatus.
FIG. 7 is an enlarged sectional view taken along 7—7 of FIG. 1 showing details of a vehicle clamp.
FIG. 8 is another sectional view taken along line 8—8 of FIG. 7.

With initial reference primarily to FIGS. 1 and 2, the illustrated apparatus for realigning vehicle body and frame members include a horizontal platform, generally indicated at 20, formed by two parallel tracks 22, 24 on which a vehicle V, indicated in phantom lines in FIG. 2, can rest.

The tracks, 22, 24 are identical so only one need be described. More particularly, track 22 is composed of a pair of elongated rectangular metal tubes 26, 28 which are held in slightly spaced parallel relation by stub rectangular tubes 30 that are welded therebetween at spaced intervals. The outer sides of the elongated tubes 26, 28 have C-shaped angle beams 32, 34 welded thereto and the inner beam flanges have a plurality of round openings 36 extending therethrough in a vertical disposition.

The two tracks 22, 24 are rigidly connected by two transverse frame members 38, 40 and the entire platform 20 is movably supported by wheels 42 adjacent its four corners. More particularly, each wheel 42 is removably attached to the platform 20 by a bolt 44 whose head rests on a small plate 46 which spans the opening between the elongated tubes 26, 28 and which is threadedly received in a wheel-supporting shank 48 projecting upwardly between the tubes.

If the two wheels 42 at the left in FIGS. 1 and 2 are removed, the left end of the entire platform 20 can swing down into engagement with the supporting surface as shown in phantom lines.

To facilitate movement of a vehicle V onto the lowered platform, a ramp 50 is pivotally connected to the end of each track 22, 24 and can automatically move from the upwardly projecting angular position shown in full lines in FIG. 2 to a coplanar disposition with the supporting track, as shown in phantom lines. It is notable that the ramp 50 projects above the track 22, 24 when in its elevated position and thus provides a stop precluding accidental movement of the vehicle from the tracks at this end.

A conventional jack under the platform 20 can be used to elevate the same once the vehicle V has been loaded thereon but it is preferred to provide an integrated pneumatic means. Such means includes a pair of auxiliary wheels 52 mounted at the lower ends of legs 54 connected pivotally at their upper ends to the center of the transverse frame member 38. A pneumatic ram 56 is pivotally connected at one end to the legs 54 and at its other end to a bracket 58 rigidly connected to the frame member 38. When air pressure is supplied to the ram 56 from a suitable source it will extend thus raising the platform 20 from its lowered phantom line position to its operative substantially horizontal position at which time the regular legs can be reconnected.

With additional reference to FIGS. 3 and 4, details of the means for exerting realigning forces on a vehicle V supported on the platform are illustrated. A carrier member, generally indicated at 60 includes an arm 62 in the form of a heavy hollow tube which is supported on four wheels 64 so as to be readily moveable into a position underneath the platform. As best shown in FIG. 3, a pivot pin 66 at the inner end of the arm 62 is arranged to pass through one of the vertical openings 36 in the track 22 and thence through a registered opening 68 at the inner end of the arm 62. Thus, the entire carrier member 60 can be pivoted about the vertical axis defined by the pin 66 to various angular positions such as indicated by full and phantom lines in FIG. 1. An additional pin 70 with an attached plate 72 can be inserted into one of several additional openings 74 in the laterally-extending arm 62 to contact the outer edge of the track 22 and maintain the desired angular disposition.

The carrier member 60 also includes an upright member 76 consisting of two hollow rectangular tubes that are welded or otherwise secured to the outer sides of the arm 62 and rise vertically in parallel relation to their upper ends which are tied together by a rigid strap 78 as best shown in FIG. 2.

A collar 80 slidably encompasses the upright member 76 and is connected to flexible cables 82 that pass to the top of the upright member and around pulleys 84 for connection at their opposite descending ends to a pair of counterweights 86 slidable inside the rectangular tubes, thus to maintain the collar 80 in any vertically adjusted position on the upright member 76.

The force-exerting means includes a pneumatic ram 88 positioned vertically in a hole in a lateral flange 90 on the collar 80. The ram 88 carries a U-shaped bracket 92 at its upper end which in turn supports a pulley 94 for rotation about a substantially horizontal axis. Another pulley 96 is supported for rotation about a horizontal axis at the inner lower side of the collar 80. A flexible member in the form of a heavy link chain 98 is trained over the top of the first pulley 94 and thence under the second pulley 96 to extend inwardly toward the vehicle V on the platform 20 for connection by a hook 100 or other connecting member to the particular element on the vehicle to be pulled. The opposite end of the chain 98 is releasably held by a keeper 102 in the form of a bifurcated extension of the flange 90 which receives the narrow edge of a chain link.

When air from a suitable source (not shown) is supplied to the ram 88, the first pulley 94 is raised thus to exert a pulling force on the chain 98. The horizontal angle of pull can be easily adjusted by pivotal motion of the carrier member 60 and the level and vertical angle of pull can be easily adjusted by raising or lowering of the collar 80. Additional keepers 104, 106 on the collar 80 and upright member 76 can releasably hold the opposite ends of another link chain 108 to preclude upward movement of the collar 80 and in turn, a pivoted hook 110 on the collar provides a releasable keeper that can engage the top of the upright member 76 to preclude downward collar movement.

If more vertical pull is desired, a modified arrangement as shown in FIGS. 5 and 6 can be utilized. FIG. 5 is similar to FIG. 3 showing the same carrier member so that corresponding reference numerals are employed. Added however is an elongated boom 112 mounted at its lower end about a horizontal pivot 114 secured at the top of a vertical pivot pin 116 extending downwardly into a selected one of the openings 74 in the lateral arm 62. Thus swinging motion of the boom 112 about both vertical and horizontal axes can occur. As best shown in FIG. 6, an arcuate slot 118 receives a bolt 120 which can be tightened to hold the boom 112 in an angularly adjusted position.

At a central and outer position, the boom 112 carries a lateral ring 122 to which the described hook 100 at the end of the link chain can be releasably connected. An extension chain 124 can be connected to the top of the boom and is adapted for connection downwardly to a vehicle element enabling an upward pull to be generated.

While the vehicle is fairly heavy and thus will not readily move when secured on the platform, if substantial forces are to be applied by the described mechanism, a vehicle clamp or clamps 140 can be employed, one of which is shown generally in FIGS. 1 and 2. With reference to these figures and additional reference to FIGS. 7 and 8, the clamp includes a flat plate 142 which is arranged to rest on top of the tracks 22, 24 and can be secured thereto by a bolt 144 which passes through a slot in the plate and the openings between the beams so that the supporting plate can be moved to any desired position on the platform to accommodate the configuration of a particular vehicle being realigned. The bolt 144 is received in a selected one of several threaded holes 147 in a base 149 slidably received in an adjusted position within the stub tubes 30. From the flat plate 142 a vertical plate 146 extends upwardly to mount clamping ears 148 at its upper extremity which through the use of suitable nuts and bolts 150 can be brought into engagement with the vehicle as most clearly shown in FIG. 8. Obviously one or more clamps can be used as required and the particular configuration with the spaced tubes 30 enables the clamps again to be positioned at any desirable location depending upon the direction of force application thereto and the particular configuration of the vehicle.

Obviously many other modifications and/or alterations can be made in the described invention and accordingly the foregoing description of two embodiments is to be considered as purely exemplary and not in a limiting sense and the actual scope of the invention is to be indicated only by reference to the appended claims.

What is claimed is:

1. In combination with a vehicle support having a pair of spaced tracks for receiving the rear and front wheels of a motor vehicle having a pair of spaced front wheels and a pair of spaced rear wheels, one such track receiving and supporting the wheels on one side of the vehicle and the other track receiving and supporting the wheels on the other side of the vehicle, a pulling structure comprising a horizontal, longitudinally extended member having a front end and a rear end, said structure also comprising a pair of spaced parallel posts having bottom ends fixed to the rear of the horizontal member and having top ends, and having an inner side facing in the same direction as the horizontal member and having an oppositely facing side means for moving the pulling structure to various positions in relation to the vehicle support with the front end of the horizontal member beneath the upper surface of said tracks means for securing the pulling structure in any of a number of desired positions and at any of several desired angles in relation to the tracks a collar surrounding and embracing said posts, such collar being movable up and down said posts to any of a number of desired positions, said collar having an outer portion adjacent the outer sides of said posts and an inner portion adjacent the inner sides of said posts a first rotary member mounted on and above the outer portion of said collar and a second rotary member mounted on and below the inner portion of said collar, the mounting of said first rotary member permitting vertical movement thereof in relation to the collar, said rotary members rotating about parallel axes power actuated means for moving said first rotary member upwardly an elongated flexible pulling member fixed at one end to the outer portion of said collar below said first rotary member, said flexible member being trained over said first rotary member extending between said posts and being trained under said second rotary member, said pulling member having means for connecting its other end to a part of a motor vehicle mounted on said tracks, such connection being either direct or indirect, whereby when said power actuated means is operated said flexible member is pulled upwardly over said first rotary member.

2. The combination of claim 1 in which said rotary members lie in substantially the same vertical plane.

3. The combination of claim 1 including counterweight means which serve to hold the collar in adjusted position on the posts until an external force is applied thereto.

4. The combination of claim 3 in which the posts are hollow and the counterweight means are located within the hollow posts.

5. The combination of claim 3 including a latch member on the collar engageable with an upper portion of the post to prevent downward movement of the collar from its desired elevated position.

6. The combination of claim 1 including a second elongated flexible member, a first keeper means on the collar and a second keeper means at or near the lower portions of the posts, said second flexible member acting when engaging said keeper means to prevent upward movement of the collar from its intended position.

* * * * *